US006601967B1

(12) United States Patent
Zeller

(10) Patent No.: US 6,601,967 B1
(45) Date of Patent: Aug. 5, 2003

(54) FLASHLIGHT WITH KEYHOLDER

(76) Inventor: Noel E. Zeller, c/o Zelco Industries, Inc., 65 Haven Ave., Mount Vernon, NY (US) 10553-4445

( * ) Notice: Subject to any disclaimer, the term of this patent is extended or adjusted under 35 U.S.C. 154(b) by 0 days.

(21) Appl. No.: 09/642,479

(22) Filed: Aug. 18, 2000

(51) Int. Cl.[7] ..... F21V 33/00
(52) U.S. Cl. ..... 362/116; 362/206
(58) Field of Search ..... 362/197, 202, 362/205, 206, 116, 203, 204

(56) References Cited

U.S. PATENT DOCUMENTS 2,114,266 A * 4/1938 Bodor ..... 362/116
2,704,556 A * 3/1955 Blish ..... 362/202
2,715,676 A * 8/1955 Fore ..... 362/116
2,737,574 A * 3/1956 Muller ..... 362/116
6,296,371 B1 * 10/2001 Shiau ..... 362/206

* cited by examiner

*Primary Examiner*—Y. My Quach-Lee
(74) *Attorney, Agent, or Firm*—Cooper & Dunham LLP; Donald S. Dowden

(57) ABSTRACT

A flashlight has a housing and a circuit mounted in the housing. The circuit includes a light, batteries for powering the light, and a switch for opening and closing the circuit. A switch control accessible from outside the housing can be pressed to close the switch and turn the light on momentarily or rotated to close or open the switch and turn the light on or off stably. The housing has a straight portion that houses batteries and a curved portion that houses a light. A key holder is attached to the straight portion by a flexible link and has a loop for holding keys. The key holder is constructed so that keys can be easily inserted in and removed from the loop and are held securely when inserted. The apparatus is well suited for use under poor ambient illumination to find a keyhole and insert a key properly for operation of a lock.

11 Claims, 2 Drawing Sheets

FLASHLIGHT WITH KEYHOLDER

BACKGROUND OF THE INVENTION

1. Field of the Invention

This invention relates to flashlights and, more particularly, to a novel and highly effective flashlight combined with a key holder for holding one or more keys.

2. Description of the Prior Art

Keys can be inconvenient to use in the dark. They are generally small and must be inserted into small keyholes that can be hard to find in the dark. When a keyhole is located in the dark, it can be hard to tell by feeling the keyhole how to orient the key in order to insert it into the keyhole and operate the lock. A key holder in combination with a flashlight is thus a useful and popular item.

However, many flashlight/key holder combinations are too large to be carried conveniently in a pocket or purse. Also, in the case of many a combination flashlight and key holder, it is not possible to point the flashlight at a keyhole while inserting the key. In addition, many such devices lack momentary-on and stable-on/off switch controls that operate reliably.

OBJECTS AND SUMMARY OF THE INVENTION

An object of the invention is to remedy the problems of conventional flashlights and combination flashlight/key holders noted above. In particular, an object of the invention is to provide a combination flashlight and key holder that is compact, weighs little, gives long service, is easy to operate, and efficiently illuminates a keyhole as the key is inserted.

In accordance with one aspect of the invention, there is provided a flashlight comprising a housing and a circuit mounted in the housing. The circuit comprises a light, at least one battery for powering the light, and a switch for opening and closing the circuit. A switch control is provided that is accessible from outside the housing. The switch control can be pressed to close the switch and turn the light on momentarily and rotated to open or close the switch and turn the light on or off stably.

In accordance with an independent aspect of the invention, there is provided a flashlight comprising a housing and a circuit mounted in the housing. The circuit comprises a light, at least one battery for powering the light, and a switch for opening and closing the circuit. A key holder is connected to the housing for holding a key and operating the switch.

In accordance with another independent aspect of the invention, there is provided apparatus comprising a cylindraceous housing having a straight first end and a curved second end, a light mounted in the second end, and a key holder. A flexible link connects the key holder to the first end. Thus a key held by the key holder can be brought forward towards the second end and the light can simultaneously illuminate the key and a keyhole into which the key is to be inserted.

BRIEF DESCRIPTION OF THE DRAWING

A better understanding of the objects, features, and advantages of the invention can be gained from the following detailed description of preferred embodiments of the invention, in conjunction with the appended figures of the drawing, wherein:

FIG. 6 is a view corresponding to FIG. 5 and showing the light when turned on;

DESCRIPTION OF THE PREFERRED EMBODIMENTS

Figure 1:
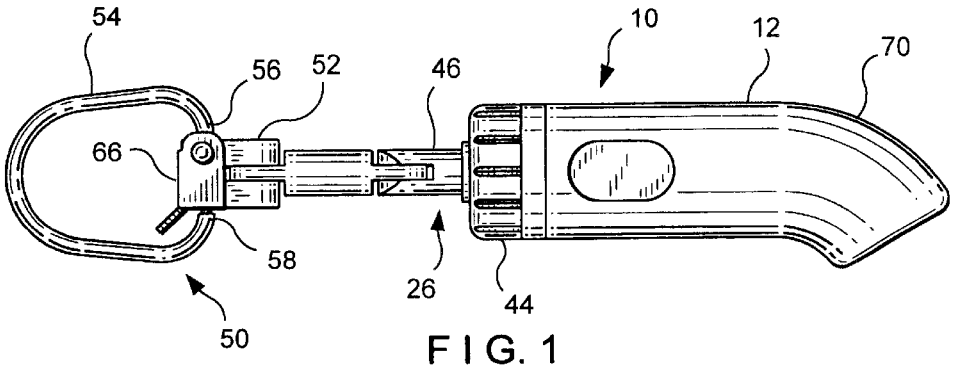
FIG. 1 is a view in front elevation of a flashlight and key holder constructed in accordance with the invention.
Figure 2:
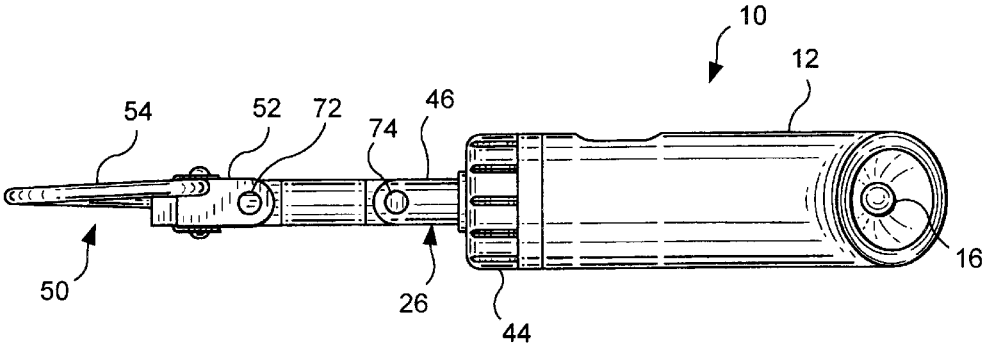
FIG. 2 is a bottom view thereof.

FIGS. 1–6 show a flashlight 10 constructed in accordance with the invention. It comprises a housing 12 and, as FIG. 5 best shows, a circuit 14 mounted in the housing 12. The circuit 14 comprises a light 16, at least one battery 18 (four lithium batteries can, for example, be employed in accordance with the invention), and a switch 20 for opening and closing the circuit 14. The switch 20 comprises a casing 22 of the battery or right-hand battery 18 shown in FIGS. 5–7 and a spring 24 that can make or break contact with the casing 22.

A switch control 26 is provided that is accessible from outside the housing 12. The switch control 26 can be pressed to close the switch 20 and turn the light 16 on momentarily or rotated to close or open the switch 20 and turn the light 16 on or off stably.

In the preferred embodiment, the switch works as follows: the battery or batteries 18 are slidably mounted in the housing 12. A compression coil spring 28 urges the battery or batteries 18 to the left in FIGS. 5–7: i.e., in a direction to open the switch 20. However, the switch control 26 is capable of forcing the battery or batteries 18 against the urging of the spring 28 in a direction to close the switch 20, as indicated in FIG. 6. That can be accomplished by manually pressing on the switch control 26, thereby forcing the battery or batteries 18 to the right, compressing the spring 28, and bringing the battery casing 22 into contact with the spring 24. The light 16 is turned on momentarily. Release of manual pressure allows the spring 28 to force the battery or batteries 18 to the left, breaking contact between the casing 22 and spring 24 and turning the light 16 off.

Figure 5:
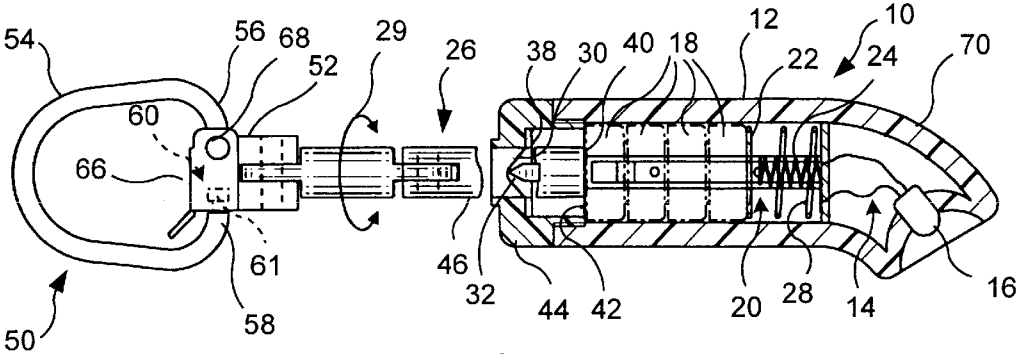
FIG. 5 is a sectional view corresponding to FIG. 1 and showing the light when turned off.
Figure 6:
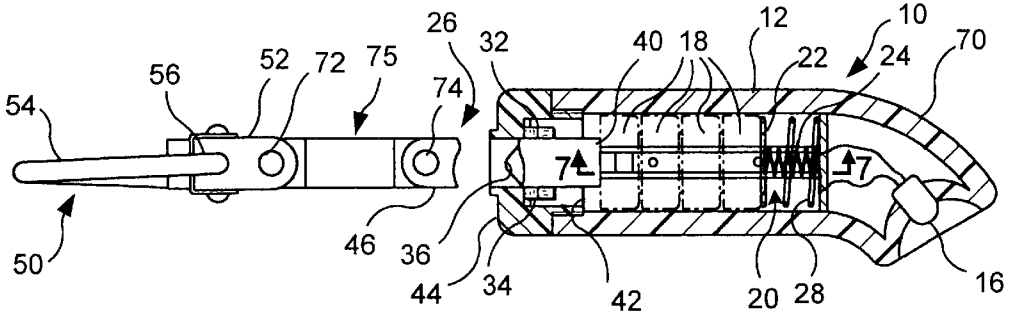
Figure 7:
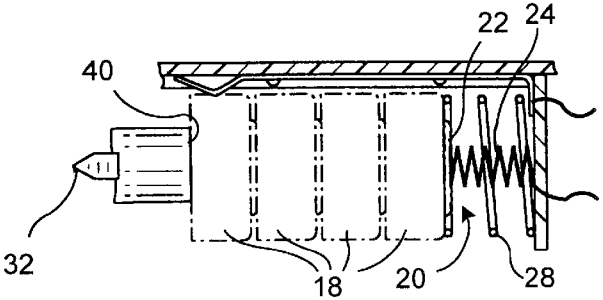
FIG. 7 is an enlarged fragmentary view along the line 7—7 of FIG. 6 and looking in the direction the arrows.

Alternatively, it can be accomplished by rotating the switch control 26 clockwise or counterclockwise through an angle of 90 degrees (or an odd multiple of 90 degrees), as indicated by a two-headed arrow 29 in FIG. 5. The switch control 26 comprises a cam 30 and cam followers 32, 34. They are constructed so that rotation of the switch control 26 from the position of FIG. 5 through an angle of 90 degrees in either direction to the position of FIG. 6 causes the cam followers 32, 34 to ride up from the lowest cam elevation 36, which the cam followers 32, 34 occupy when the light is turned off, to the highest cam elevation 38, which the cam followers 32, 34 occupy when the light is turned on. For clarity, the reference numeral 36 and its associated lead line showing the lowest cam elevation are illustrated in FIG. 6 and the reference numeral 38 and its associated lead line showing the highest cam elevation are illustrated in FIG. 5. However, the cam followers 32, 34 are at the lowest cam elevation in FIG. 5 and at the highest cam elevation in FIG. 6.

The right end 40 of the switch control 26 abuts the left side 42 of the battery (or left-most battery) 18. Consequently, rotation of the switch control 26 from the position of FIG. 5 to the position of FIG. 6 moves the battery or batteries 18 from the position of FIG. 5 to the position of FIG. 6, compressing the spring 28 and causing the casing 22 to close with the spring 24, thereby completing a circuit from the battery or batteries 18 to the light 16 and turning the light on.

By the same token, when the switch control 26 is rotated from the position of FIG. 6 to the position of FIG. 5, the cam followers 32, 34 are displaced from the highest cam elevation 38, and the spring 28 expands, forcing the battery or batteries 18 to the left and dropping the cam followers 32, 34 to the lowest cam elevation.

The structure and operation described above, in which the off condition of the light 16 corresponds to a less compressed condition of the spring 28, is preferred. Since the light 16 is usually turned off, the spring 28 is usually in a more relaxed condition. However, it is also within the scope of the invention to reverse the operation so that the spring 28 is more compressed when the light 16 is turned off than when it is turned on.

The cam 38 is formed on the inside of a cap 44 that can be removed to provide access to the battery or batteries 18. The switch control 26 includes a portion 46 that is integral with the cam followers 32, 34 and extends through the cap 44. A key holder 50 is connected to the extension 46. The key holder 50 comprises a base 52 and a loop 54. The loop 54 has a first end 56 permanently attached to the base 52 and a second end 58 removably attached to the base 52 so that the loop 54 can pass through the eye of a key (not shown) and the second end 58 can be attached to the base 52 to secure the key or detached from the base 52 as indicated by an arrow 59 (FIG. 8) to permit the key to be removed.

Figure 8:
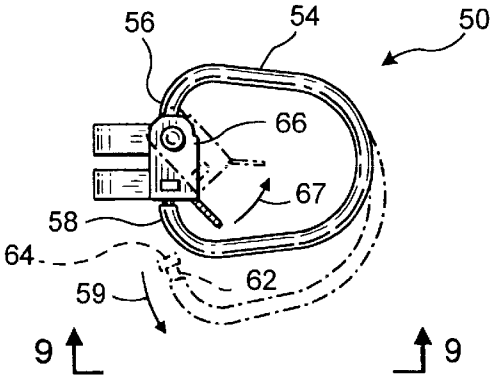
FIG. 8 is a fragmentary view of the key holder.
Figure 9:
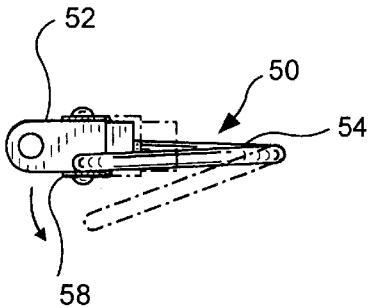
FIG. 9 is a view along the line 9—9 of FIG. 8 and looking in the direction of the arrows.

The base 52 has a retaining portion 60 (FIG. 5) formed as a slot with an enlarged portion 61. The second end of the loop 58 has a portion 62 (FIG. 8) of reduced diameter and a portion 64 of larger diameter that fits within the enlarged portion 61 of the slot 60. A guard member 66 is movable as indicated by an arrow 67 between a guard position, wherein it prevents, and a release position, wherein it enables, release of the second end 58 of the loop 54 by the retaining portion 60. In FIG. 8, the guard position of the guard member 66 and the attached position of the second end 58 are illustrated with solid lines, and the release position of the guard member 66 and second end 58 are illustrated with broken lines.

In accordance with a further aspect of the invention, the flashlight housing 12 is formed as a cylinder having an axis that is straight in part and curved in part. The axis has a straight portion that accommodates the battery or batteries 18 and extends from the cap 44 to a region 70 near the light 16. From the region 70, the axis of the cylinder housing curves through an arc of substantially 45 degrees.

Figure 3:
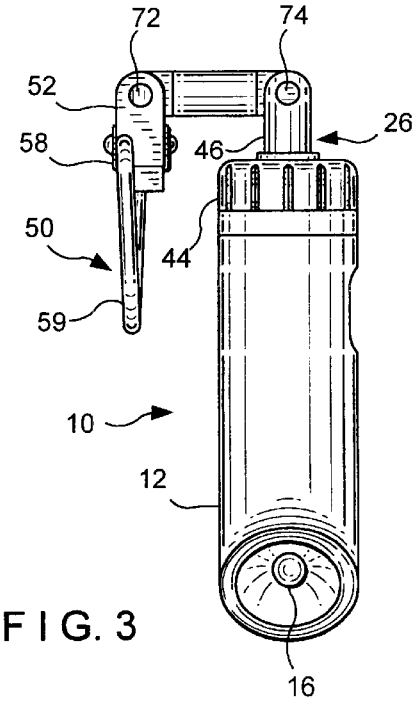
FIG. 3 is a bottom view showing the key holder in a different configuration.
Figure 4:
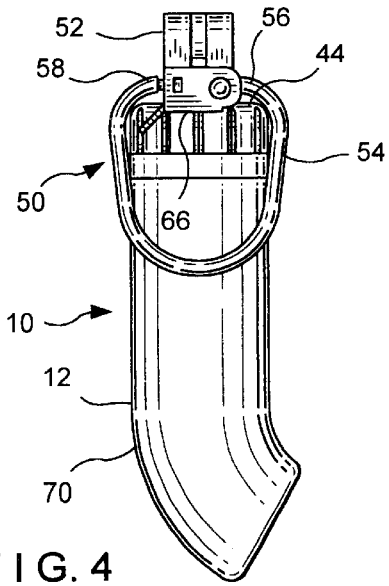
FIG. 4 is a rear view thereof.

When the light is turned on as in FIG. 6, a key retained in the loop 54 can be brought forward towards the light by bending the link 75, which is articulated at pivot shafts 72 and 74. That in combination with the curve of the housing enables the light 16 to illuminate the key and keyhole simultaneously as the key is inserted into the keyhole. The light when turned on can thus be used efficiently to find a keyhole, insert the key properly and operate the lock. Note that FIGS. 3 and 4 show the key holder brought forward towards the light 16 when the light is turned off. When the key holder 50 is rotated 90 degrees out of the plane of FIG. 3 towards the observer or 90 degrees to the right in FIG. 4, the light 16 is turned on and a key held in the key holder can be illuminated by the light 16 together with a keyhole as the key is inserted into the keyhole. In FIG. 6, which shows the light 16 when turned on, a key held in the key holder 50 can be brought forward towards the right by pivoting the link 75 counterclockwise about the pivots 72 and 74.

Preferably, the housing is made of a translucent material so that, when the light 16 is turned on, some light passes through the end of the housing 12 adjacent the light 16. The flashlight is thus capable of providing some illumination over a wide arc, especially at close range.

Thus there is provided in accordance with the invention a novel and highly effective flashlight that accomplishes the objects of the invention set out above. Many modifications of the preferred embodiments of the invention disclosed above will readily occur to those skilled in the art. The invention includes all such modifications as fall within the scope of the appended claims.

What is claimed is:

1. A flashlight comprising:

a cylindraceous housing having a first end and a second end having a curved axis;

an electrical circuit mounted in the housing and comprising a light adjacent the second end, at least one battery for powering the light, and a switch for opening and closing the circuit;

a switch control adjacent the first end accessible from outside the housing; and a key holder associated with the switch control and having a plurality of links adjacent the first end for holding a key;

wherein the switch control can be selectively pressed to close the switch and turn the light on momentarily or rotated to close or open the switch and turn the light on or off stably and the key holder can be independently moved towards the second end.

2. A flashlight comprising:

a cylindraceous housing having an end with a curved axis;

an electrical circuit mounted in the housing and comprising a light, at least one battery for powering the light, and a switch for opening and closing the circuit; and a switch control accessible from outside the housing;

wherein the switch control can be selectively pressed to close the switch and turn the light on momentarily or rotated to close or open the switch and turn the light on or off stably; and wherein the battery is slidably mounted in the housing, further comprising a spring urging the battery in a direction to open the switch, the switch control being capable of forcing the battery against the urging of the spring in a direction to close the switch.

3. A flashlight comprising:

a housing;

an electrical circuit mounted in the housing and comprising a light, at least one battery for powering the light, and a switch for opening and closing the circuit; and a switch control accessible from outside the housing, wherein:

the switch control can be selectively pressed to close the switch and turn the light on momentarily or rotated to close or open the switch and turn the light on or off stably;

a portion of the switch is mounted movably between an open position and a closed position;

the flashlight further comprises a spring urging said portion of the switch towards one of the open and closed positions; and the switch control comprises a cam and cam follower constructed so that rotation of the switch control when said portion of the switch is in said one of the open and closed positions forces said portion of the switch against the urging of the spring to the other of the open and closed positions and when the switch is in said other of the open and closed positions allows the spring to move said portion of the switch to said one of the open and closed positions.

4. A flashlight comprising:

a housing;

an electrical circuit mounted in the housing and comprising a light, at least one battery for powering the light, and a switch for opening and closing the circuit; and a switch control accessible from outside the housing, wherein:

the switch control can be selectively pressed to close the switch and turn the light on momentarily or rotated to close or open the switch and turn the light on or off stably; and a portion of the switch is mounted movably between an open position and a closed position;

the flashlight further comprises a spring urging said portion of the switch towards one of the open and closed positions and a housing cap that can be opened to provide access to the battery; and the switch control comprises a cam formed on the cap and a cam follower engaging the cam and having an extension portion that extends through the cap and can be manually rotated, wherein rotation of the cam follower extension when said portion of the switch is in said one of the open and closed positions forces said portion of the switch against the urging of the spring to the other of the open and closed positions and when the switch is in said other of the open and closed positions allows the spring to move said portion of the switch to said one of the open and closed positions.

5. Apparatus comprising:

a cylindraceous housing having a first end and a second end having a curved axis;

an electrical circuit mounted in the housing and comprising a light adjacent the second end, at least one battery for powering the light, and a switch for opening and closing the circuit; and a key holder connected to the housing adjacent the first end for holding a key and comprising a plurality of links for operating the switch and enabling movement of the key towards the second end independently of operation of the switch.

6. Apparatus according to claim 5 wherein the axis has a straight portion and a portion that curves though an arc of substantially 45 degrees.

7. Apparatus comprising:

a housing having an end with a curved axis;

an electrical circuit mounted in the housing and comprising a light, at least one battery for powering the light, and a switch for opening and closing the circuit; and a key holder connected to the housing for holding a key and comprising a link for operating the switch;

wherein the key holder comprises a base and a loop, the loop having a first end permanently attached to the base and a second end removably attachable to the base so that the loop can pass through the eye of a key to secure it and can be opened to permit the key to be removed.

8. Apparatus comprising:

a housing having an end with a curved axis;

an electrical circuit mounted in the housing and comprising a light, at least one battery for powering the light, and a switch for opening and closing the circuit; and a key holder connected to the housing for holding a key and comprising a link for operating the switch, wherein the key holder comprises a base and a loop, the loop having a first end permanently attached to the base and a second end removably attachable to the base so that the loop can pass through the eye of a key and the second end can be attached to the base to secure the key or detached from the base to permit the key to be removed;

the base has a retaining portion; and the second end is configured to be selectively retained or released by the retaining portion.

9. Apparatus comprising:

a housing;

an electrical circuit mounted in the housing and comprising a light, at least one battery for powering the light, and a switch for opening and closing the circuit; and a key holder connected to the housing for holding a key and comprising a link for operating the switch; wherein:

the key holder comprises a base and a loop, the loop having a first end permanently attached to the base and a second end removably attachable to the base so that the loop can pass through the eye of a key and the second end can be attached to the base to secure the key or detached from the base to permit the key to be removed;

the base has a retaining portion; and the second end is configured to be selectively retained or released by the retaining portion;

further comprising a guard member movable between a guard position wherein it prevents, and a release position wherein it enables, release of the second end of the loop by the retaining portion.

10. Apparatus comprising:

a housing; and an electrical circuit mounted in the housing and comprising a light, at least one battery for powering the light, and a switch for opening and closing the circuit; and a key holder connected to the housing for holding a key and comprising a link for operating the switch;

wherein the housing comprises a translucent material adjacent the light so that light rays pass through the housing adjacent the light and provide illumination over a wide arc at close range.

11. Apparatus comprising:

a cylindraceous housing having a straight first end and a second end having a curved axis;

a light mounted adjacent the second end;

a key holder;

a flexible connection between the key holder and the first end; and a switch electrically connected to the light and operable independently of the flexible connection;

whereby a key held by the key holder can be brought forward towards the second end and the light can simultaneously illuminate or not illuminate the key and a keyhole into which the key is to be inserted.

* * * * *